US010365006B2

(12) United States Patent
McQueeny, Jr. et al.

(10) Patent No.: US 10,365,006 B2
(45) Date of Patent: Jul. 30, 2019

(54) AIR DIFFUSER WITH MANUAL AND MOTORIZED PLATES

(71) Applicant: AIRFIXTURE LLC, Kansas City, KS (US)

(72) Inventors: Michael J. McQueeny, Jr., Leawood, KS (US); James E. Megerson, Shawnee, KS (US); David S. Alstatt, Shawnee, KS (US); Pedro J. Bermudez, Olathe, KS (US); J. Patrick McQueeny, Leawood, KS (US)

(73) Assignee: AIRFIXTURE, LLC, Kansas City, KS (US)

( * ) Notice: Subject to any disclaimer, the term of this patent is extended or adjusted under 35 U.S.C. 154(b) by 984 days.

(21) Appl. No.: 14/509,969

(22) Filed: Oct. 8, 2014

(65) Prior Publication Data

US 2015/0099456 A1 Apr. 9, 2015

Related U.S. Application Data

(60) Provisional application No. 61/888,380, filed on Oct. 8, 2013.

(51) Int. Cl.
*F24F 13/12* (2006.01)
*F24F 13/06* (2006.01)
*F24F 13/14* (2006.01)

(52) U.S. Cl.
CPC ..... *F24F 13/06* (2013.01); *F24F 13/12* (2013.01); *F24F 13/1426* (2013.01)

(58) Field of Classification Search
CPC ..... F24F 13/06; F24F 13/12; F24F 13/1426; F24F 2221/40
USPC ..... 454/274, 290, 317, 324
See application file for complete search history.

(56) References Cited

U.S. PATENT DOCUMENTS 232,166 A * 9/1880 Bales ..... F24F 7/00 454/274
2,541,346 A * 2/1951 De Roo ..... F24F 13/14 454/322
3,314,353 A * 4/1967 Knab ..... E04C 2/42 251/255
4,030,518 A * 6/1977 Wilcox ..... E04B 9/02 137/246

(Continued)

*Primary Examiner* — Gregory L Huson
*Assistant Examiner* — Frances F. Hamilton
(74) *Attorney, Agent, or Firm* — Shook, Hardy & Bacon, L.L.P.

(57) ABSTRACT

A mechanism for opening and closing a damper valve of a diffuser mechanism is provided. Embodiments of the invention include a damper construction that selectively alters the amount of air flow through a diffuser grille using a three-plate damper valve. The three-plate damper valve includes a manual plate, a fixed plate, and a motorized plate. The manual plate is manually rotatable around a central axis, while the motorized plate is mechanically rotatable about the same axis. The motorized plate is mechanically and/or remotely controlled using a stepper motor coupled to the motorized plate. Further, the diffuser mechanism includes a sensor for determining the location of the motorized plate with respect to a starting position. As such, multiple configurations of the manual plate and the motorized plate may be used to alter the air flow through the resulting channels of the damper mechanism.

16 Claims, 3 Drawing Sheets

(56) References Cited

U.S. PATENT DOCUMENTS 4,061,082 A * 12/1977 Shuler ..... F24F 13/068 454/298
6,019,677 A * 2/2000 Demster ..... F24F 7/10 454/289
6,083,100 A * 7/2000 Hardy ..... F24F 13/068 454/290
6,192,922 B1 * 2/2001 MacGibbon ..... F16K 3/085 137/486
6,231,438 B1 * 5/2001 Laudermilk ..... F24F 13/068 454/290
6,296,562 B1 * 10/2001 Uemura ..... B60H 1/00692 251/901
6,340,329 B1 * 1/2002 Park ..... F24F 11/053 454/258
6,544,117 B1 * 4/2003 Hardy ..... F24F 7/10 454/290
6,981,915 B2 * 1/2006 Moore ..... F24F 11/053 137/553
7,431,638 B2 * 10/2008 Natsume ..... B60H 1/00692 137/614.11
7,470,178 B2 * 12/2008 Tajiri ..... B60H 1/00685 454/155
7,628,686 B2 * 12/2009 Rimmer ..... F24F 13/105 454/290
7,950,988 B2 * 5/2011 Demster ..... F24F 7/10 454/284
2003/0139133 A1 * 7/2003 Hardy ..... F24F 7/10 454/290
2004/0198214 A1 * 10/2004 Karidis ..... F24F 7/10 454/186
2006/0246835 A1 * 11/2006 Rimmer ..... F24F 13/105 454/290
2007/0066213 A1 * 3/2007 Helgeson ..... F24F 13/06 454/247
2009/0258591 A1 * 10/2009 Carter ..... F24F 13/12 454/309
2011/0097989 A1 * 4/2011 McQueeny, Jr. ..... A47B 13/00 454/289
2014/0179214 A1 * 6/2014 Rinke ..... H05K 7/20836 454/184
2015/0024673 A1 * 1/2015 Phelps ..... F24F 13/12 454/256

* cited by examiner

AIR DIFFUSER WITH MANUAL AND MOTORIZED PLATES

CROSS-REFERENCE TO RELATED APPLICATIONS

This application claims priority to U.S. Provisional Patent Application Ser. No. 61/888,380, filed Oct. 8, 2013, having the same title, the disclosure of which is hereby incorporated herein in its entirety by reference.

STATEMENT REGARDING FEDERALLY SPONSORED RESEARCH OR DEVELOPMENT

Not applicable.

BRIEF SUMMARY OF THE INVENTION

The present invention relates to a device for automatically or manually opening and closing a damper valve of a diffuser mechanism. More particularly, this invention relates to a damper construction that alters the amount of air flow through a diffuser grille using a three-plate damper valve. Portions of the three-plate damper valve are motorized and may be automatically and/or remotely controlled, while other portions may be manually manipulated to adjust an available amount of air flow through the housing of the diffuser mechanism.

Dampers consisting of a damper vane which rotates within a housing to selectively restrict and permit the passage of air through the housing are well known in the art. One particular construction known to be beneficial is disclosed in U.S. Patent Application Publication No. 2007/0066213 A1, which is incorporated herein in its entirety. It discloses a damper coupled with an air delivery assembly to create a floor terminal for use in a raised floor air distribution system. The vane of the damper opens and closes a passageway to selectively permit air to pass therethrough from a plenum under the raised floor, into the air delivery system and then up into a room through the floor.

Another particular construction known to be beneficial is disclosed in U.S. Pat. No. 7,950,988 B2, which is incorporated herein in its entirety. It discloses a diffuser for positioning in a passageway. The diffuser has an air adjustment assembly that includes a manually movable plate that cooperates with a grate to selectively control the size of openings through the grate and, thereby, control the volume of air flowing through the diffuser into the room above.

As best illustrated in FIG. 5, embodiments of the air diffuser include a diffuser grille 40 coupled to a trash pan 18 that secures and/or surrounds a three-plate damper valve having a manual plate 42, a fixed plate 44, and a motorized plate 46 that is operable by coupling to a fixed circuit box 24 housing a stepper motor. As shown in the various views of FIGS. 1-5, first and second gears 28 and 30 coupled to the motorized plate 46, in conjunction with features of an interrupt sensor 22, control the various embodiments of the diffuser mechanism.

Accordingly, in one embodiment of the invention, a diffuser mechanism includes a housing having an upper diffuser grille, a lower trash pan, and a plurality of legs coupling the diffuser grille to the trash pan. A three-plate damper valve is coupled to the housing, which includes a manual plate, a fixed plate, and a motorized plate. The diffuser mechanism further includes a magnetically-driven stepper motor that powers the motorized plate. The manual plate is positioned below and adjacent to the diffuser grille, the fixed plate is below and adjacent to the manual plate, and the motorized plate is below and adjacent to the fixed plate such that the fixed plate is positioned between the manual plate and the motorized plate.

In embodiments, the diffuser mechanism housing includes a central axis about which each of the manual plate and the motorized plate is rotatable. Accordingly, the motorized plate is continuously rotatable about the central axis in a single direction. In an alternate embodiment, the motorized plate is reversible; however, a single direction of rotation has benefits from a wear standpoint. The diffuser mechanism also includes an interrupt sensor configured to determine a position of the motorized plate with respect to the diffuser mechanism. It further includes a first gear coupled to the magnetically-driven stepper motor and a second gear coupled to the three-plate damper valve. As such, the first gear may be coupled to a drive shaft of the magnetically-driven stepper motor. The magnetically-driven stepper motor may be coupled to a fixed mounting plate contained in a fixed circuit box that houses electronics for controlling the magnetically-driven stepper motor. The second gear may be coupled to the motorized plate of the three-plate damper valve.

In another embodiment of the invention, a diffuser includes a housing having an upper diffuser grille, a lower trash pan, and a leg structure configured to couple the upper diffuser grille to the lower trash pan; a three-plate damper valve coupled to the housing, the three-plate damper valve having a manual plate adjacent the upper diffuser grille, the manual plate having a tab that extends beyond a top surface of the upper diffuser grille, a fixed plate adjacent the manual plate, and a motorized plate adjacent the fixed plate, where the motorized plate and the manual plate are rotatable around a central axis of the housing; a magnetically-driven stepper motor configured to selectively rotate the motorized damper in a first direction; a first rotation gear coupled to the stepper motor; a second rotation gear coupled to the motorized damper; and an interrupt sensor configured to determine a location of the motorized plate with respect to the stepper motor.

In embodiments, the diffuser includes at least one air channel for movement of air through the diffuser based on alignment of the manual plate, the fixed plate, and the motorized plate. Further, the motorized plate may be mechanically returned to a starting position based on a determination of a position of the motorized plate with respect to the interrupt sensor. In embodiments, rotation of each of the motorized plate and the manual plate around the central axis of the housing allows an amount of air to flow through at least one channel of the diffuser based on alignment of at least one of the motorized plate and the manual plate with an opening of the diffuser grille and the fixed plate.

A further embodiment of the invention is directed to a diffuser having a stationary diffuser grille; a first plate; a second plate; and a third plate, where the first plate is manually rotatable with respect to the stationary diffuser grille, and further where the third plate is a motor-driven plate that is rotatable in a single direction with respect to the diffuser grille based on coupling the third plate to a magnetically-driven stepper motor. At least one air channel for movement of air through the diffuser is created based on an orientation of one or more of the first plate, the second plate, and the third plate. In embodiments, orientation of the first plate with respect to the stationary diffuser grille provides at least one air channel for movement of air through the diffuser grille. In further embodiments, orientation of the third plate with respect to the stationary diffuser grille provides at least one air channel for movement of air through the diffuser grille.

Further objects, features and advantages of the present invention over the prior art will become apparent from the detailed description of the drawings which follows, when considered with the attached figures.

BRIEF DESCRIPTION OF THE SEVERAL VIEWS OF THE DRAWINGS

The features of the invention noted above are explained in more detail with reference to the embodiment illustrated in the attached drawing figures, in which like reference numerals denote like elements, in which FIGS. 1-5 illustrate one possible embodiment of the present invention, and in which:

FIG. 1 is a top perspective view of a diffuser mechanism having a three-plate damper valve and a diffuser grille, constructed in accordance with an embodiment of the present invention;

FIG. 2 is a side elevation view of the diffuser mechanism of FIG. 1, in accordance with an embodiment of the present invention;

FIG. 3 is an enlarged, fragmentary, cross-sectional, elevation view of the diffuser mechanism of FIG. 1, in accordance with an embodiment of the present invention;

FIG. 4 is a bottom perspective view of the diffuser mechanism of FIG. 1, with portions of the diffuser mechanism removed for clarity, in accordance with an embodiment of the present invention; and FIG. 5 is an exploded top perspective view of the diffuser mechanism of FIG. 1, in accordance with an embodiment of the present invention.

DETAILED DESCRIPTION OF THE INVENTION

Figure 1:
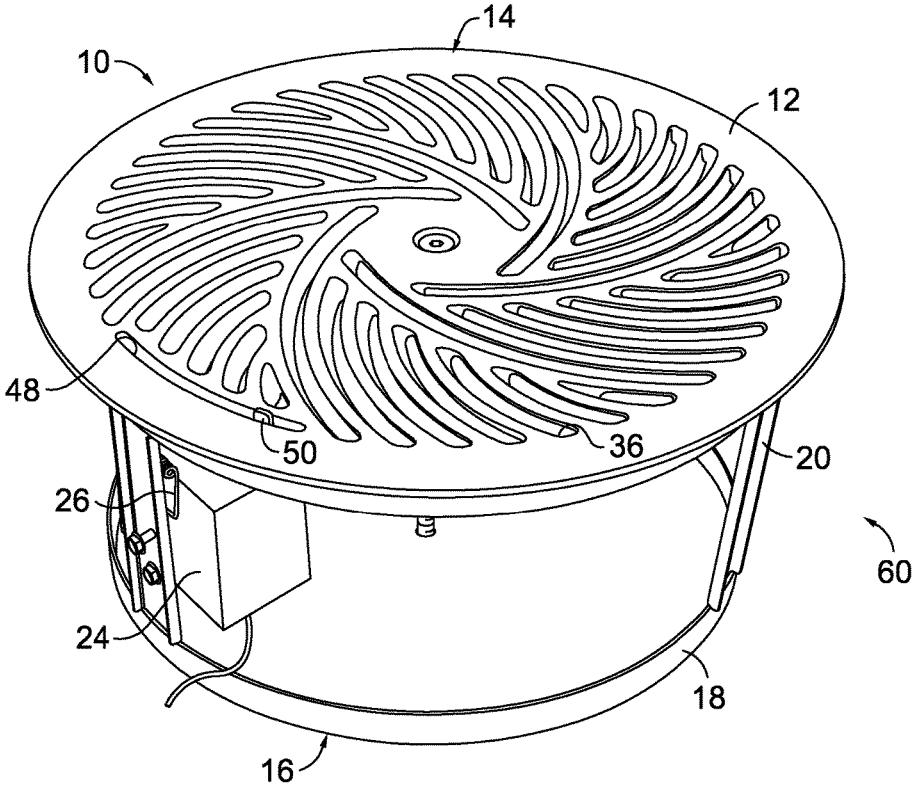

Referring now to the drawings in more detail, numeral 10 generally designates a diffuser mechanism having a three-plate damper valve constructed in accordance with an embodiment of the present invention. The diffuser mechanism has a top diffuser grille 12 coupled to a bottom trash pan 18, which encloses a three-plate damper valve, corresponding gears, and magnetically-driven stepper motor, as discussed in more detail below.

Turning now to FIG. 1, a diffuser mechanism 10 having a diffuser grille 12 with a three-plate damper valve for controlling an amount of air flowing through the diffuser mechanism 10 is depicted in accordance with an embodiment of the present invention. The diffuser mechanism 10 includes the diffuser grille 12 positioned on a top side 14, a bottom side 16 having the trash pan 18, multiple trash pan legs 20 around the perimeter of the diffuser mechanism 10, an interrupt sensor 22 (FIG. 2), and a fixed circuit box 24 (housing a magnetically-driven stepper motor) coupled one of the trash pan legs 20. The diffuser mechanism 10 also includes a housing 60 having the diffuser grille 12, the trash pan 18, and the multiple trash pan legs, and the three-plate damper valve is coupled to the housing 60. As will be understood, a variety of mechanisms may be used to couple the stationary components of the diffuser mechanism 10, including additional and/or alternative trash pan legs 20.

Figure 2:
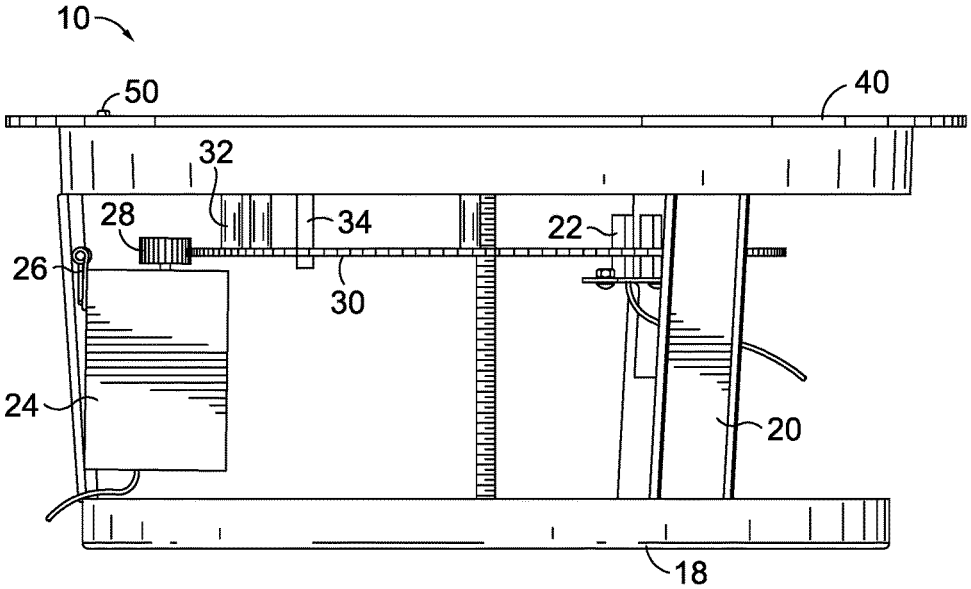
Figure 3:
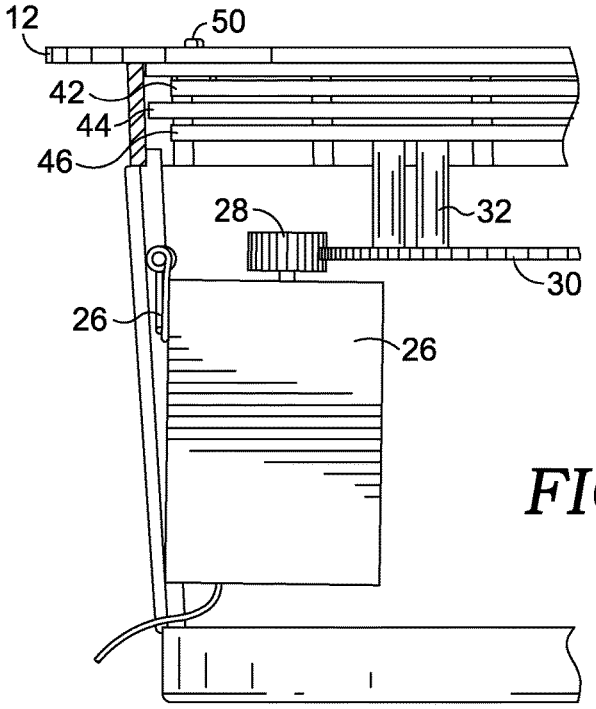

When viewed from the side in FIGS. 2 and 3, the diffuser mechanism 10 further includes a first gear 28 coupled to the stepper motor, a second gear 30 coupled to the three-plate damper valve, a plurality of gear spacers 32 for coupling the second gear 30 to the three-plate damper valve, and a sensor tab 34 coupled to or formed as part of the motorized plate of the three-plate damper mechanism. The fixed circuit box 24 may be pivotally coupled to the leg 20 and biased toward a center of the diffuser mechanism 10 by a biasing means 26 (e.g., a spring) to maintain the first gear 28 in contact with the second gear 30 during operation. The biasing allows the gears to maintain contact and accommodate irregularities between the gears and their mounting positions, as well as account for wear. As depicted in FIG. 1, the diffuser mechanism 10 includes a slot 48 in the surface of the diffuser grille 12 through which a tab 50 is extended for manual control by a user. Additionally, as shown in FIG. 1, a plurality of openings 36 on the diffuser grille 12 provide one or more channels for air exiting the diffuser mechanism 10.

Figure 4:
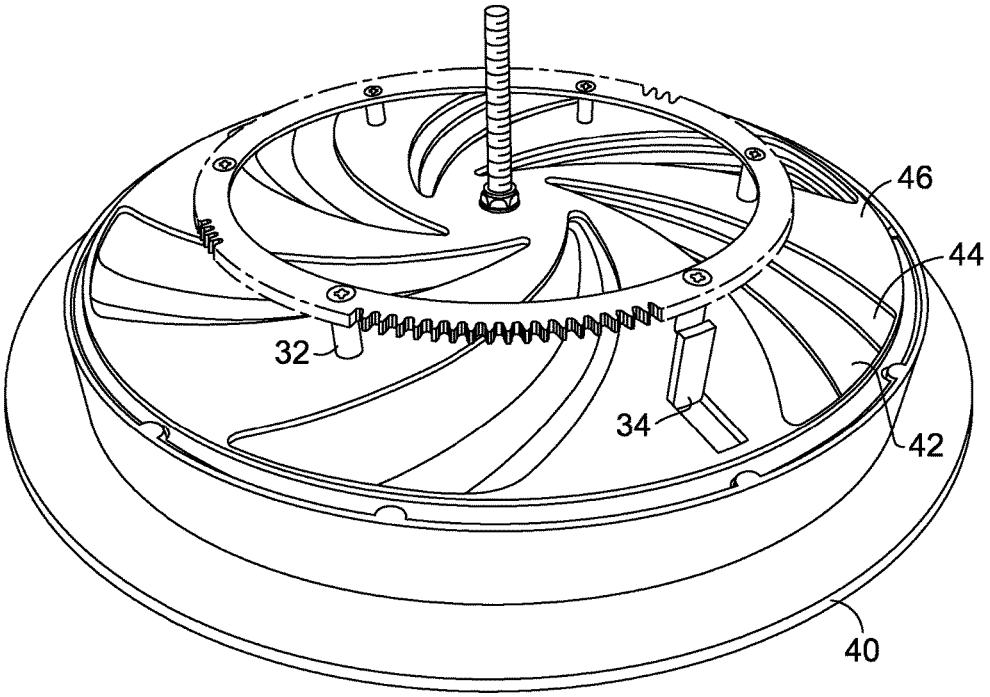

FIG. 4 depicts a bottom view of the diffuser grille 10 with a three-plate damper valve. The three-plate damper valve includes the manual plate 42 which is positioned adjacent the diffuser grille 40. The fixed plate 44 of the three-plate damper valve is added, adjacent the manual plate 42, and aligned along the same central axis of the diffuser mechanism 38. The motorized plate 46 is positioned adjacent the fixed plate 44. When all of the plates 42, 44, and 46, of the three-plate damper valve are aligned, a maximum amount of air flow is permitted to travel through the diffuser grille 12 of the diffuser mechanism 38.

As shown in the cross-sectional view of FIG. 3, the plurality of plates in the three-plate damper valve are positioned with respect to the diffuser grille 12 to permit or restrict an amount of air flow through the diffuser mechanism. In operation, the manual plate 42 may be manually rotated around the central axis of the diffuser mechanism 38, thereby altering an alignment of openings of the manual plate 42 with respect to the other plates (particularly the fixed plate 44) and the diffuser grille 12. Similarly, the motorized plate 46 may be mechanically rotated about the central axis of the diffuser mechanism 38, thereby altering an alignment of openings of the motorized plate 46 with respect to the other plates and the diffuser grille 12. In embodiments, the relationship between the fixed plate 44 and the moveable plates 42 and 46 controls the amount of air that may flow through the damper valve and, in turn, the diffuser grille 12. In other embodiments, the fixed plate 44 may be omitted and it is the relationship between the moveable plates 42, 46 and the openings in the diffuser grille 12 that controls the amount of air that may flow through the diffuser grille 12.

In operation, rotation of the first gear 28 by the stepper motor housed inside fixed circuit box 24 causes rotation of the second gear 30 coupled to the motorized plate 46. The first gear 28 may be rotated based on a remote control command received by the stepper motor, as directed by a user of the diffuser mechanism 10. For example, a thermostat device controlling an amount of heated or cooled air flowing to a particular room may identify a desired amount of air flow to a room, and mechanically adjust the amount of air through the diffuser mechanism 10 based on manipulation of the motorized plate 46. Using interrupt sensor 22, the same system may recognize, using sensor tab 34 coupled to the motorized plate 46, the starting position of the motorized plate 46, and adjust the corresponding movement necessary to achieve the desired orientation (and air flow) using the motorized plate 46.

Figure 5:
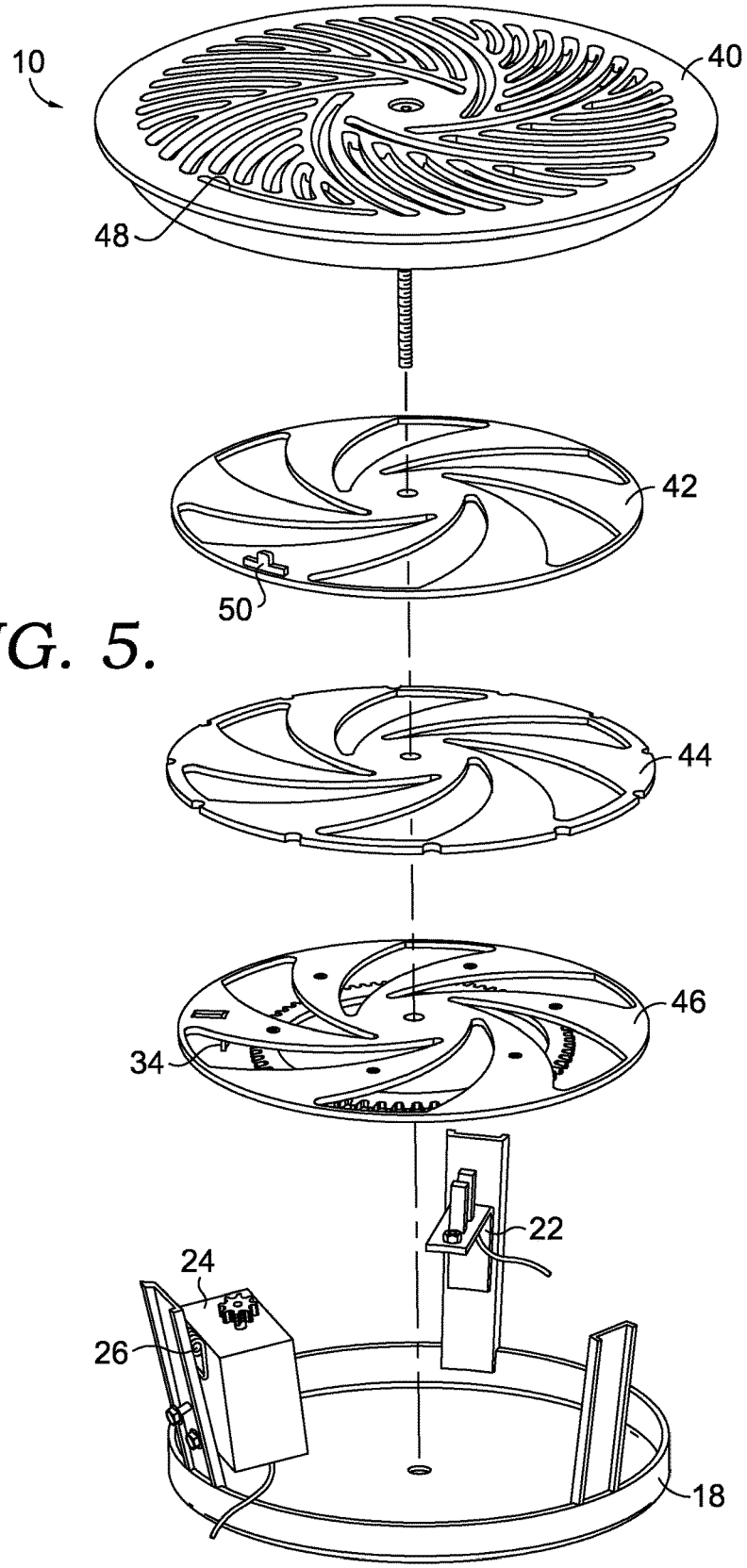

A user may also adjust the amount of air flowing through the diffuser mechanism 10 using the manual plate 42. Accordingly, the openings of the manual plate 42 may be moved into a desired position with respect to the diffuser grille 12 (and the fixed plate 44) based on sliding of the tab 50 within slot 48. Further, while the fanned, cut-out pattern of each of the plates of the three-plate damper valve, as best depicted in the deconstructed views of FIG. 5, include a six-sectioned circular pattern, it will be understood that a variety of corresponding cut-out plate patterns may be used to alter the air flow through a diffuser grille using the three-plate damper valve of the present invention. In particular, embodiments of the three-plate damper valve include a motorized plate and a manual plate for manipulation with respect to a central, stationary plate—all of which may or may not correspond to the opening pattern of the stationary diffuser grille. In the illustrated embodiments, the openings in the fixed plate 44 correspond with the openings in the movable plates 42, 46, such that either movable plate 42, 46 may be aligned with the fixed plate 44 to present alignment of the corresponding openings (thereby permitting air to flow directly through the damper valve), offset from the fixed plate 44 fully to prevent direct flow of air through the damper valve, or offset any amount there between to permit variable or reduce volume of direct flow or air through the damper valve.

Accordingly, the present invention discloses a diffuser with a damper construction with improved controlling features for automatically and/or manually opening and closing a damper valve. Many variations can be made to the illustrated embodiment of the present invention without departing from the scope of the present invention. Such modifications are within the scope of the present invention. For example, the diffuser grille could be replaced with a grille having additional vented openings or a different configuration of openings on the diffuser grille (and corresponding damper valve plates) to provide various air flow patterns. Additionally, the gears 28, 30 may be spaced away from the plates 42, 44, 46. For example, the circuit box 24 and motor may be mounted underneath the trash pan 18, along with the gears 28, 30, and a drive shaft extend therefrom and be coupled to the motorized plate. Also, while the motor described herein has been referred to as a stepper motor, other types of motors will work and are within the scope of the present invention. Other modifications would be within the scope of the present invention.

From the foregoing it will be seen that this invention is one well adapted to attain all ends and objects hereinabove set forth together with the other advantages which are obvious and which are inherent to the method and apparatus. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A diffuser mechanism comprising:

a housing having an upper diffuser grille, a lower trash pan, and a plurality of legs coupling the diffuser grille to the trash pan;

a three-plate damper valve coupled to the housing, wherein the three-plate damper valve includes:

a manual plate positioned below, parallel and adjacent to the diffuser grille and rotatable about a central axis parallel to a path of airflow through the diffuser grille;

a fixed plate positioned below, parallel and adjacent to the manual plate, the fixed plate in a fixed relationship to the diffuser grille, wherein the manual plate is rotatable with respect to the fixed plate to selectively control a volume of airflow through the diffuser grille; and a motorized plate positioned below, parallel and adjacent to the fixed plate and rotatable around a central axis that is coaxial with the central axis of the manual plate, wherein the motorized plate is rotatable with respect to the fixed plate to selectively control a volume of airflow through the diffuser grille; and a motor coupled with the motorized plate to selectively actuate rotation of the motorized plate.

2. The diffuser mechanism of claim 1, wherein the motor is a magnetically driven stepper motor.

3. The diffuser mechanism of claim 1, wherein the motorized plate is rotatable in a first direction and a second direction opposite the first direction.

4. The diffuser mechanism of claim 1, wherein the motorized plate is selectively rotatable about the central axis in a single direction.

5. The diffuser mechanism of claim 4, further comprising an interrupt sensor configured to determine a position of the motorized plate with respect to the diffuser grille.

6. The diffuser mechanism of claim 2, further comprising a first gear coupled to the magnetically-driven stepper motor and a second gear coupled to the three-plate damper valve.

7. The diffuser mechanism of claim 6, wherein the first gear is coupled to a fixed mounting plate of a fixed circuit box, wherein the fixed circuit box houses the magnetically-driven stepper motor, and further wherein the second gear is coupled to the motorized plate of the three-plate damper valve.

8. A diffuser comprising:

a housing having an upper diffuser grille, a lower trash pan, a central axis, and a leg structure configured to couple the upper diffuser grille to the lower trash pan;

a three-plate damper valve coupled to the housing, the three-plate damper valve comprising:

a manual plate adjacent a bottom surface of the upper diffuser grille, the manual plate having a tab that extends upward beyond a top surface of the upper diffuser grille;

a fixed plate adjacent the manual plate; and a motorized plate adjacent the fixed plate, wherein the motorized plate, the fixed plate, and the manual plate are parallel and aligned along the central axis, and wherein the motorized plate and the manual plate are independently rotatable around the central axis;

a magnetically-driven stepper motor configured to selectively rotate the motorized plate in a first direction;

a first rotation gear coupled to the stepper motor;

a second rotation gear coupled to the motorized damper; and an interrupt sensor configured to determine a location of the motorized plate with respect to the stepper motor.

9. The diffuser of claim 8, wherein at least one air channel for movement of air through the diffuser is based on alignment of the manual plate, the fixed plate, and the motorized plate.

10. The diffuser of claim 8, wherein the motorized plate is mechanically returned to a starting position based on a determination of a position of the motorized plate with respect to the interrupt sensor.

11. The diffuser of claim 8, wherein rotation of each of the motorized plate and the manual plate around the central axis of the housing allows an amount of air to flow through at least one channel of the diffuser based on alignment of at least one of the motorized plate and the manual plate with an opening of the diffuser grille.

12. A diffuser comprising:

a stationary diffuser grille;

a central axis extending downwardly from the stationary diffuser grill;

a first plate adjacent the diffuser grill, the first plate having a first opening;

a second plate adjacent the first plate, the second plate having a second opening; and a third plate adjacent the second plate, the third plate having a third opening; and wherein the first, second and third plates cooperate to selectively control the flow of air through the openings in the first, second, and third plates in a direction, parallel to the central axis and perpendicular to the first, second, and third plates and the diffuser grille, wherein the first plate is manually rotatable with respect to the stationary diffuser grille, and wherein the third plate is a motor-driven plate that is rotatable in a single direction with respect to the diffuser grille, and wherein the third plate is coupled to a magnetically-driven stepper motor.

13. The diffuser of claim 12, wherein at least one air channel for movement of air through the diffuser is created based on an orientation of one or more of the first plate and the third plate.

14. The damper of claim 13, wherein alignment of the first plate with respect to the second plate provides at least one air channel for movement of air through the first and second plates.

15. The damper of claim 13, wherein alignment of the third plate with respect to the second plate provides at least one air channel for movement of air through the second and third plates.

16. The damper of claim 12, wherein each of the first, second, and third plates have at least one opening therethrough, wherein the first and third plates are movable to align their openings with the opening through the second plate, thereby permitting air to flow directly through the first, second and third plates, and wherein either of the first and third plates may be moved with respect to the second plate to offset their opening with the opening in the second plate to prevent direct flow of air through the first, second and third plates.

* * * * *